US008957820B2

(12) United States Patent
Yamada

(10) Patent No.: US 8,957,820 B2
(45) Date of Patent: Feb. 17, 2015

(54) ANTENNA ELEMENT-WAVEGUIDE CONVERTER AND RADIO COMMUNICATION DEVICE USING THE SAME

(75) Inventor: Atsushi Yamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 921 days.

(21) Appl. No.: 13/045,561

(22) Filed: Mar. 11, 2011

(65) Prior Publication Data

US 2011/0234466 A1 Sep. 29, 2011

(30) Foreign Application Priority Data

Mar. 25, 2010 (JP) ..... 2010-069513

(51) Int. Cl.
*H01Q 13/00* (2006.01)
*H01Q 13/06* (2006.01)

(52) U.S. Cl.
CPC ..... *H01Q 13/06* (2013.01)
USPC ..... 343/786

(58) Field of Classification Search
CPC ..... H01Q 13/06
USPC ..... 343/786, 772
See application file for complete search history.

(56) References Cited

U.S. PATENT DOCUMENTS

| | | | | |
|---|---|---|---|---|
| 2003/0042993 | A1 | 3/2003 | Sayanagi et al. | |
| 2008/0068269 | A1 | 3/2008 | Yamada | |
| 2009/0000329 | A1 | 1/2009 | Colberg et al. | |
| 2009/0066590 | A1 * | 3/2009 | Yamada et al. | 343/702 |
| 2011/0187482 | A1 | 8/2011 | Ohno et al. | |

FOREIGN PATENT DOCUMENTS

| | | | |
|---|---|---|---|
| CN | 101145638 | A | 3/2008 |
| CN | 101383343 | A | 3/2009 |
| JP | 8-125432 | A | 5/1996 |
| JP | 2003-78310 | | 3/2003 |
| JP | 2008-72659 | | 3/2008 |
| JP | 2008-131513 | A | 6/2008 |
| JP | 2009-081833 | | 4/2009 |
| JP | 2009-525453 | A | 7/2009 |
| WO | WO 2009/017203 | A1 | 2/2009 |

* cited by examiner

*Primary Examiner* — Robert Karacsony
(74) *Attorney, Agent, or Firm* — Birch, Stewart, Kolasch & Birch, LLP

(57) ABSTRACT

An antenna element-waveguide converter includes an antenna substrate having, on one surface, an antenna element and rectangular metal plates arranged in a plurality of rows to surround this antenna element, and a waveguide having, at one end, an opening opposed to the one surface of the antenna substrate. Surfaces of the rectangular metal plates and the opening of the waveguide are arranged with a predetermined gap left therebetween in a direction perpendicular to the one surface of the antenna substrate. Thus arranging the antenna substrate and the waveguide avoids a stress due to assembly variations, which can achieve favorable antenna characteristics.

2 Claims, 6 Drawing Sheets

ANTENNA ELEMENT-WAVEGUIDE CONVERTER AND RADIO COMMUNICATION DEVICE USING THE SAME

This nonprovisional application is based on Japanese Patent Application No. 2010-069513 filed on Mar. 25, 2010 with the Japan Patent Office, the entire contents of which are hereby incorporated by reference.

BACKGROUND OF THE INVENTION

1. Field of the Invention

The present invention relates to an antenna element-waveguide converter used for microwave or milliwave band communication, and the radio communication device using the same.

2. Description of the Background Art

In recent years, attention is being focused on radio transmission for a high definition television broadcast (hereinafter referred to as HDTV). Since the HDTV radio transmission involves transmission of a large volume of information, a radio transmission system using milliwaves that can secure a wide transmission bandwidth is being developed. Accordingly, for application to such a radio transmission system, a compact radio communication device is being developed in which a high frequency line is converted into a waveguide, and connected to a horn antenna or the like.

FIG. 7A is an exploded perspective view of a high frequency line-waveguide converter of a conventional radio communication device described in Japanese Patent Laying-Open No. 2008-131513, and FIG. 7B shows a central longitudinal section of the high frequency line-waveguide converter of the radio communication device as assembled. The high frequency line-waveguide converter includes a coplanar line 102 provided at a surface 101*a* of a dielectric substrate 101, an antenna element 103 arranged in a notch area 113 of a first ground layer 111, and a waveguide 104 attached to first ground layer 111. First ground layer 111 is provided on a rear surface 101*b* of dielectric substrate 101, and a second ground layer 112 is provided in the middle of dielectric substrate 101. Coplanar line 102 is composed of a linear microstrip line 121 provided in surface 101*a* of dielectric substrate 101 and a rectangular cavity area 122. Rectangular notch area 113 is provided at a position of first ground layer 111 substantially directly below cavity area 122 of coplanar line 102.

Antenna element 103 is provided on rear surface 101*b* of dielectric substrate 101 so as to be located in notch area 113. As shown in FIG. 7B, this antenna element 103 is located substantially directly below a leading end 121*a* of microstrip line 121 of coplanar line 102. This antenna element 103 is connected to leading end 121*a* of microstrip line 121 with one via hole 130. As shown in FIG. 7A, antenna element 103 connected to microstrip line 121 with via hole 130 is shielded by a plurality of via holes 131 provided along the outer peripheral edge of notch area 113 and the inner peripheral edge of cavity area 122.

Waveguide 104 is a quadrangular cylindrical standard waveguide, and is attached to first ground layer 111 with opening 140 opposed to notch area 113.

More specifically, notch area 113 corresponding to the shape of cavity area 122 is set to have the same shape as opening, 140 of waveguide 104, and waveguide 104 is attached to first ground layer 111 with opening 140 aligned with this notch area 113.

The operation of the high frequency line-waveguide converter of the conventional radio communication device shown in FIGS. 7A and 7B will now be described. A microstrip line (not shown) which is an output terminal of an external apparatus (not shown) is connected to microstrip line 121 of the waveguide-high frequency line converter of this conventional example, so that a signal is input from the external apparatus. The input signal propagates through coplanar line 102 toward leading end 121 of microstrip line 121. Then, this signal passes through leading end 121*a* of microstrip line 121 and via hole 130 to reach antenna element 103, and is radiated from antenna element 103 to propagate through waveguide 104.

Japanese Patent Laying-Open No. 8-125432 discloses a feed horn-integrated type LNB (Low Noise Block) converter having a configuration in which many through holes are arranged to form a circular shape in an internal layer of a multilayer substrate to constitute a waveguide section, which is connected to a waveguide section of the feed horn.

However, the conventional art having the structure as described above raises the following problems.

Generally, a waveguide is a mass of metal, which is rigid and heavy, whereas a substrate is fragile and light. Therefore, how to connect these two members having different mechanical strengths has been an important structural issue for ensuring the quality of a high frequency line-waveguide converter. In this respect, in Japanese Patent Laying-Open No. 2008-131513, a substrate on which a high frequency line is arranged and a waveguide are directly attached to each other, while in Japanese Patent Laying-Open No. 8-125432, a substrate and a chassis integrally molded with a waveguide are secured with a screw and the like. However, since the thickness of the substrate and the shape of the waveguide vary within a range of dimensional tolerances depending on individual differences, merely physically pressing them one upon the other may cause insufficient contact. Insufficient contact between the substrate and the waveguide may cause a problem in that a drop in antenna gain is directly affected when, for example, an antenna such as a feed horn is integrally molded with the waveguide. If the waveguide and the substrate are pressed excessively strongly one upon the other for sufficient contact, then, a stress produced at that time may damage the substrate and components such as ICs mounted on the substrate.

To deal with these problems, the waveguide may be indirectly connected to the substrate with another material for connection between the waveguide and the substrate, such as a conducting material, interposed therebetween. However, such connection disadvantageously complicates the manufacturing process, resulting in higher product cost.

SUMMARY OF THE INVENTION

To solve the above-described problems encountered in the conventional art, an object of the present invention is to provide an antenna-waveguide converter improved in reliability by avoiding a stress due to assembly of a substrate and a waveguide, without complicating the manufacturing process and without increasing the product cost.

To achieve the above-described object, the antenna element-waveguide converter in accordance with the present invention includes a first substrate having, on one surface, an antenna element and rectangular metal plates arranged in a plurality of rows so as to surround the antenna element, and a waveguide having, at one end, a first opening opposed to the one surface of the first substrate. Surfaces of the rectangular metal plates and the first opening of the waveguide are arranged with a predetermined gap left therebetween in a direction perpendicular to the one surface of the first substrate.

In the antenna element-waveguide converter in accordance with the present invention, in an embodiment of the present invention, adjacent ones of the rectangular metal plates are arranged at a constant spacing.

In the antenna element-waveguide converter in accordance with the present invention, in an embodiment, the first substrate includes a ground conductor plate between the one surface and the other surface, and each of the rectangular metal plates and the ground conductor plate are connected with a through hole.

In the antenna element-waveguide converter in accordance with the present invention, in a preferred embodiment, adjacent ones of the rectangular metal plates and a path defined by the ground conductor plate and by the through hole constitute a resonant circuit, and the resonant circuit has a frequency equal to the frequency of a radiation wave from the antenna element.

In the antenna element-waveguide converter in accordance with the present invention, the surfaces of the rectangular metal plates and the first opening of the waveguide are preferably arranged with a gap left therebetween, the gap being less than or equal to 1/10 of a wavelength of a radiation wave from the antenna element.

In the antenna element-waveguide converter in accordance with the present invention, in an embodiment, a high frequency circuit is mounted on the other surface of the first substrate.

In the antenna element-waveguide converter in accordance with the present invention, in an embodiment, a horn antenna having a second opening larger than the first opening is coupled to the other end of the waveguide.

A radio communication device in accordance with the present invention includes a first substrate having, on one surface, an antenna element and a plurality of rectangular metal plates arranged around the antenna element, a second substrate on which the first substrate is mounted, a waveguide having, at one end, a first opening opposed to the one surface of the first substrate, a horn antenna having a second opening coupled to the waveguide, and a housing accommodating the first substrate and the second substrate. Surfaces of the plurality of rectangular metal plates and the first opening of the waveguide are arranged with a predetermined gap left therebetween in a direction perpendicular to the one surface of the first substrate.

In the radio communication device in accordance with the present invention, in an embodiment, the horn antenna is supported by the housing, or the horn antenna is integrally molded with the housing.

In accordance with the present invention having the above-described structure, arranging surfaces of a plurality of rectangular metal plates provided on a first substrate together with an antenna element with a predetermined gap from an opening of a waveguide prevents contact between the first substrate on which the plurality of rectangular metal plates are provided and the waveguide. This avoids a stress that would be caused by assembly of the first substrate and the waveguide, so that an antenna element-waveguide converter improved in reliability can be achieved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

A first embodiment of an antenna element-waveguide converter of the present invention will be described with reference to FIGS. 1A to 4.

Figure 1A:
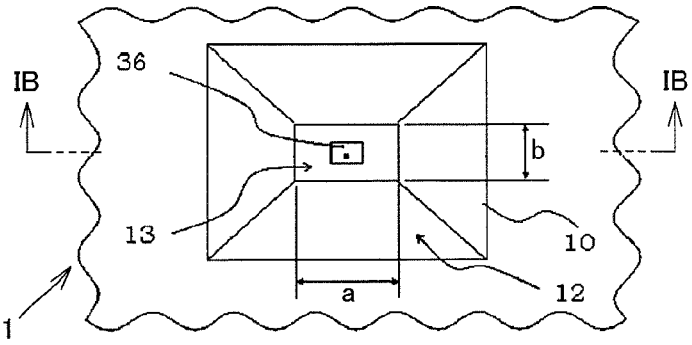
FIG. 1A is a plan view of part of an antenna element-waveguide converter of a first embodiment of the present invention as viewed from an antenna surface.
Figure 1B:
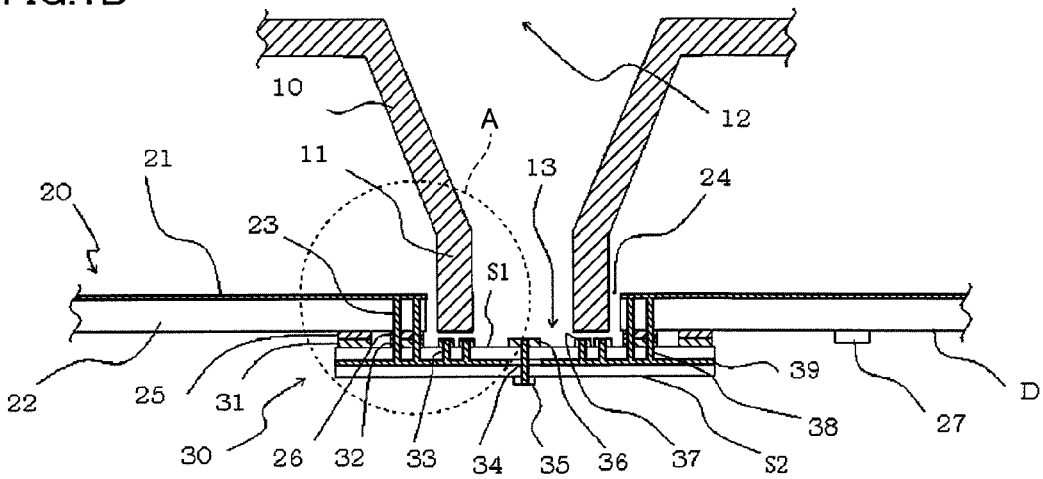
FIG. 1B is a cross sectional view taken along the broken line IB-IB of FIG. 1A.

First, a configuration example of an antenna element-waveguide converter 1 in the first embodiment will be described with reference to FIGS. 1A and 1B. As shown in FIG. 1B, antenna element-waveguide converter 1 includes antenna substrate 30, a waveguide 11 arranged with an opening 13 opposed to a surface of this antenna substrate 30, and horn antenna 10 coupled to waveguide 11. Antenna substrate 30 is mounted on a mounting board 20 in application to a radio communication device. It should be noted that antenna substrate 30, opening 13, and mounting board 20 correspond to a first substrate, a first opening, and a second substrate of the present invention, respectively.

An example of the overall configuration of antenna substrate 30 will now be described with reference to FIG. 1B. Antenna substrate 30 is implemented by a multilayer substrate made of a low-temperature co-fired ceramic, for example. Antenna substrate 30 has mounted thereon an antenna element and a high frequency circuit (not shown) composed of a transmission line and a semiconductor integrated circuit on the substrate. An antenna element 36 and a connection terminal 31 to mounting board 20 are formed on antenna surface S1 of antenna substrate 30, and a high frequency circuit (not shown) connected to a power feed line 35 is formed on a circuit surface S2. A ground conductor plate 39 is formed within antenna substrate 30 as an internal layer. Antenna substrate 30 further has a through hole 34 formed to extend from antenna element 36 to reach power feed line 35 on circuit surface S2, and a through hole 38 formed to extend from a rectangular ring-shaped ground portion 32 to reach ground conductor plate 39.

An example configuration of each part of antenna substrate 30 will now be described in detail with reference to FIGS. 1B and 2A to 2C. First, antenna element 36 is made of a rectangular metal conductor formed by etching processing of a metal conductor of antenna surface S1. Antenna element 36 is arranged at a central area of antenna surface S1 such that each side edge has a dimension matching the wavelength of a frequency used, and so as to be in parallel to substrate edges. Further, as shown in FIG. 1B, antenna element 36 is connected to power feed line 35 with through hole 34. It should be noted that antenna element 36 is not limited to a rectangular shape, but may have a circular shape, for example, depending on the wavelength of a frequency used, and may be arranged at any position of antenna surface S1 as far as the arrangement is allowed. Furthermore, in the present embodiment, antenna element 36 is made of the metal conductor of antenna surface S1 of antenna substrate 30, however, this is not a limitation, and the antenna element may be implemented by an antenna element part of a different member.

Figure 2A:
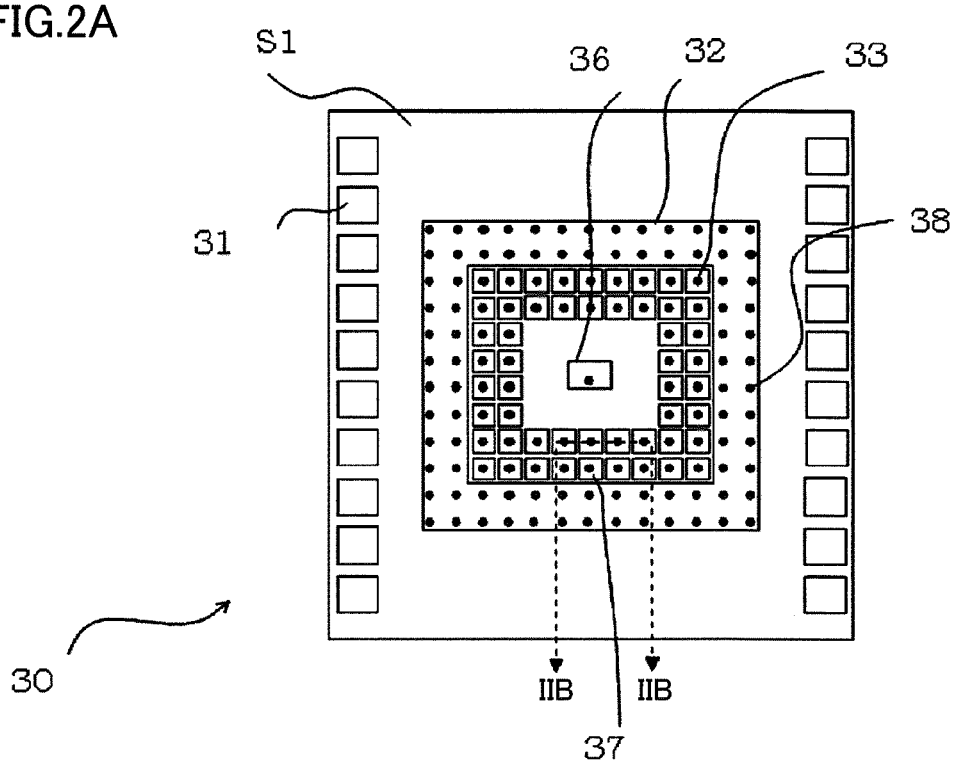
FIG. 2A is a plan view of an antenna substrate 30 in accordance with the first embodiment as viewed in a direction perpendicular to antenna surface S1.

Rectangular metal plates 37 will now be described with reference to FIGS. 2A to 2C. As shown in FIG. 2A, rectangular metal plates 37 are also made of the metal conductor of antenna surface S1 as well as antenna element 36, and are arranged in a plurality of rows at constant spacings so as to surround antenna element 36. As shown in FIG. 1B, each rectangular metal plate 37 is connected to ground conductor plate 39 with a through hole 33. Each side edge of rectangular metal plate 37 preferably has the same dimension as that of an adjacent rectangular metal plate 37, that is, each rectangular metal plate preferably has a square planar shape.

Figure 2B:
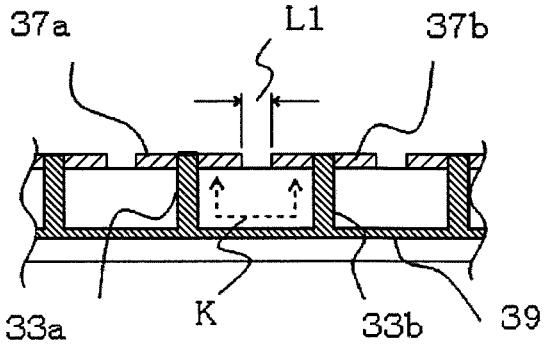
FIG. 2B is a cross sectional view taken along the broken line IIB-IIB in FIG. 2A.
Figure 2C:
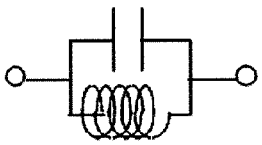
FIG. 2C shows an electrically equivalent circuit of a resonant circuit configured by the structure shown in FIG. 2B.

As shown in FIG. 2B, rectangular metal plates 37*a* and 37*b* are arranged at a constant spacing L1, and are connected to ground conductor plate 39 with through holes 33*a* and 33*b*, respectively. Rectangular metal plates 37*a* and 37*b* adjacent to each other separated by spacing L1 and a path K indicated by the broken line defined by through holes 33*a* and 33*b* and by an area of ground conductor plate 39 between through holes 33*a* and 33*b* constitute a resonant circuit including a capacitor and an inductor. FIG. 2C shows an equivalent circuit of this resonant circuit. The resonance frequency of this resonant circuit is set to be equal to the frequency of an electromagnetic wave radiated from antenna element 36. It should be noted that the embodiment shown in FIG. 2A gives an example in which rectangular metal plates 37 are arranged in two rows in parallel to the respective side edges of the antenna substrate so as to surround antenna element 36 arranged at the center, and one side of a rectangular metal plate in the first row is opposed to one side of an adjacent rectangular metal plate in the second row with no displacement from each other, however, this is not a limitation. More specifically, for example, rectangular metal plates 37 may be arranged in three or more rows depending on the frequency and the electric field strength of an electromagnetic wave radiated from antenna element 36. Moreover, one side of a rectangular metal plate in one row and one side of a rectangular metal plate of another row adjacent thereto may be opposed in a staggered manner.

Rectangular ring-shaped ground portion 32 will now be described. As shown in FIG. 2A, rectangular ring-shaped ground portion 32 is also made of the metal conductor of antenna surface S1 as well as rectangular metal plate 37, and is arranged so as to surround a plurality of rectangular metal plates 37. Rectangular ring-shaped ground portion 32 is connected to ground conductor plate 39 with a plurality of through holes 38 and connected to a ground portion 26 provided on mounting board 20, as shown in FIG. 1B.

Connection terminals 31 will now be described. As shown in FIG. 2A, connection terminals 31 are arranged along two opposed substrate side edges of antenna surface S1 of antenna substrate 30. These connection terminals 31 are used for connecting a power source, a ground, a signal terminal, and so forth (none shown) arranged on antenna substrate 30 to a connection terminal 25 provided on mounting board 20 as shown in FIG. 1B. It should be noted that the number and the arrangement of connection terminals 31 are preferably set depending on the length of substrate side edges and set to satisfy the mounting strength to mounting board 20.

Ground conductor plate 39 will now be described. Ground conductor plate 39 is provided on the internal layer between antenna surface S1 and a high-frequency circuit surface S2 of antenna substrate 30, as shown in FIG. 1B. As shown in FIG. 1B, ground conductor plate 39 is formed over the entire internal layer except that an area of ground conductor plate 39 where a through hole 34 is to be formed is removed.

An example configuration of mounting board 20 will now be described with reference to FIGS. 1B and 3. Mounting board 20 is implemented by a printed circuit board including a dielectric base material 22 of glass epoxy, and a surface mounted component 27, such as a capacitor and a resistor, required for radio communications is mounted on this mounting board 20. Mounting board 20 has a through hole 24 of a dimension substantially equal to the inner rectangle of rectangular ring-shaped ground portion 32 at a position opposed to the inner rectangular area of rectangular ring-shaped ground portion 32 of antenna substrate 30. Ground portion 26 and connection terminal 25 are provided on a mounting surface D of mounting board 20 on which antenna substrate 30 is mounted. A metal surface 21 is formed on a surface opposite to mounting surface D of mounting board 20. Mounting board 20 also has a through hole 23 formed to extend from ground portion 26 to reach metal surface 21. The configuration of ground portion 26 has a rectangular ring shape similar to the configuration of rectangular ring-shaped ground portion 32 of antenna substrate 30, and both are connected in a manner bonded to each other. Ground portion 26 is arranged along the circumference of through hole 24 of mounting board 20.

Horn antenna 10 will now be described with reference to FIGS. 1A, 1B and 3. Horn antenna 10 is made of metal and has, at its one end, an opening 12 through which an electric wave is radiated. Waveguide 11 having opening 13 opposed to antenna substrate 30 is coupled to the other end of horn antenna 10. In this embodiment, horn antenna 10 and waveguide 11 are integrally molded and coupled to each other by way of example, however, this is not a limitation, and a horn antenna and a waveguide, implemented by separate members, may be connected and coupled to each other. Opening 13 of waveguide 11 has a long side a satisfying the relation of $\lambda/2 \leq a \leq \lambda$ relative to a wavelength $\lambda$ of a radiation wave and a short side b satisfying the relation of $b=a/2$. Antenna element 36 of antenna substrate 30 is located at the center of this opening 13, and opening 13 is arranged at a predetermined distance from surfaces of rectangular metal plates 37. More specifically, as shown in FIG. 3, opening 13 of waveguide 11 coupled to horn antenna 10 and the surfaces of rectangular metal plates 37 are arranged with a gap L2 left therebetween. In this embodiment, by way of example, gap L2 is set at 0.04 wavelength, that is, a physical length of 0.2 mm, when a radiation wave has a frequency of 60 GHz. In this case, waveguide 11 is inserted into through hole 24 of mounting board 20 to be arranged in a manner that opening 13 and rectangular metal plates 37 are separated by a gap.

The operation when antenna element-waveguide converter 1 performs a transmission process will now be described with reference to FIGS. 1B, 2A to 2C, 3, and 4. In FIG. 1B, a transmitted signal is input to a high frequency circuit (not shown) mounted on high frequency circuit surface S2 of antenna substrate 30, so that a high frequency signal is generated. This high frequency signal propagates from the high frequency circuit to antenna element 36, passing through power feed line 35 and through hole 34, so that an electromagnetic wave which is the transmitted signal is radiated. The electromagnetic wave radiated from antenna element 36 propagates through opening 13 of waveguide 11 to opening 12 of horn antenna 10 to be radiated to an outer space.

At this time, the electromagnetic wave radiated from antenna element 36 contains a surface wave propagating on antenna surface S1 of antenna substrate 30 on which antenna element 36 is mounted to the substrate edges, in addition to the above-described radiation wave propagated through waveguide 11 and horn antenna 10 to be radiated to the space. In this embodiment, when the surface wave propagates from antenna element 36 to the substrate edges of antenna substrate 30, the surface wave first reaches rectangular metal plates 37 since a plurality of rectangular metal plates 37 are provided between antenna element 36 and rectangular ring-shaped ground portion 32. At this time, the resonant circuit composed of rectangular metal plates 37*a* and 37*b* adjacent to each other separated by spacing L1 and path K indicated by the broken line defined by through holes 33*a* and 33*b* and by an area of ground conductor plate 39 between through holes 33*a* and 33*b* is set to resonate at around the frequency of the radiation wave. Therefore, this resonant circuit has a higher impedance than the surface wave, so that the surface wave from antenna element 36 is reflected toward antenna element 36 without reaching the substrate edges. This surface wave then propagates through waveguide 11 and horn antenna 10, and is radiated to the outer space.

Figure 3:
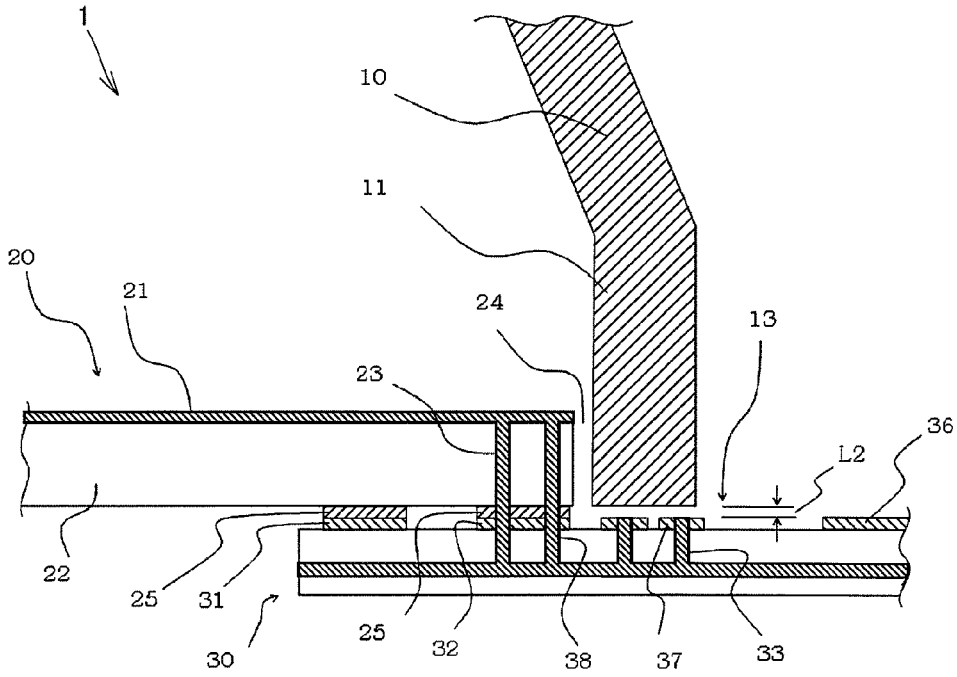
FIG. 3 is an enlarged view of an essential part of the antenna element-waveguide converter in accordance with the first embodiment, showing an area indicated by broken lined circle A in FIG. 1B.
Figure 4:
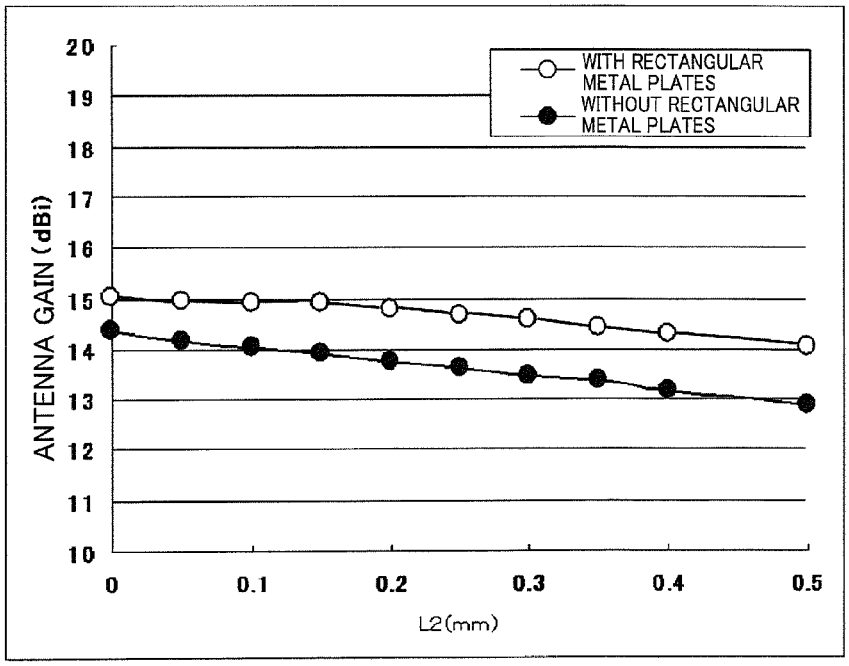
FIG. 4 shows antenna gain of the antenna element-waveguide converter in accordance with the first embodiment.

With reference to FIGS. 3 and 4, the relationship of a gap L2 between waveguide opening 13 and the surface of rectangular metal plate 37 with the operation at the time when antenna element-waveguide converter 1 performs a transmission process will now be described. FIG. 4 is a graph showing the relationship between antenna gain of a 60-GHz band antenna used in the present embodiment and gap L2 shown in FIG. 3, in which the vertical axis represents the antenna gain, and the horizontal axis represents gap L2. The graph of FIG. 4 shows results of both the cases where rectangular metal plates 37 are provided and where no rectangular metal plates 37 are provided. When no rectangular metal plates 37 are provided, the antenna gain is lower by about 0.7 dB than in the case where rectangular metal plates 37 are provided even when there is no gap L2. Further, in the case where no rectangular metal plates 37 are provided, the antenna gain will drop significantly when gap L2 is made if only a little, and, when the gap is 0.2 mm (0.04 wavelength relative to 60 GHz), the antenna gain will drop by about 0.6 dB. In contrast, in the case where rectangular metal plates 37 are provided, a drop in antenna gain can be suppressed to about 0.2 dB even if 0.2 mm of gap L2 exists. When gap L2 is 0.5 mm (0.1 wavelength relative to 60 GHz), a drop in antenna gain in the case where rectangular metal plates 37 are provided is about 1 dB, so that a drop in antenna gain can be suppressed by about 0.5 dB as compared to a drop of about 1.5 dB in the case where no rectangular metal plates 37 are provided.

As described above, in accordance with the first embodiment of the present invention, arranging a plurality of rectangular metal plates 37 around antenna element 36 with a gap left between opening 13 of waveguide 11 and the surfaces of the rectangular metal plates 37 in the direction perpendicular to antenna substrate 30 exerts the following effects. The surface wave of the electromagnetic wave radiated from antenna element 36, which would propagate on the surface of antenna substrate 30 to the substrate edges, is blocked by rectangular metal plates 37 while a mechanical stress between waveguide 11 and antenna substrate 30 is avoided, so that propagation of the electromagnetic wave from antenna substrate 30 to waveguide 11 can be achieved with a low loss. Since rectangular metal plates 37 can be formed on the surface of antenna substrate 30 in the same step as antenna element 36, there is an effect of improving performance of antenna element-waveguide converter 1 without increasing the number of manufacturing steps. Moreover, since opening 13 of waveguide 11 coupled to horn antenna 10 has long side a satisfying the relation of $\lambda/2 \leq a \leq \lambda$, relative to a wavelength $\lambda$ of a radiation wave and short side b satisfying the relation of $b=a/2$, only a TE10 mode optimal for radiation can propagate with a low loss, and a cross polarization ratio can also be improved.

Second Embodiment

Figure 5A:
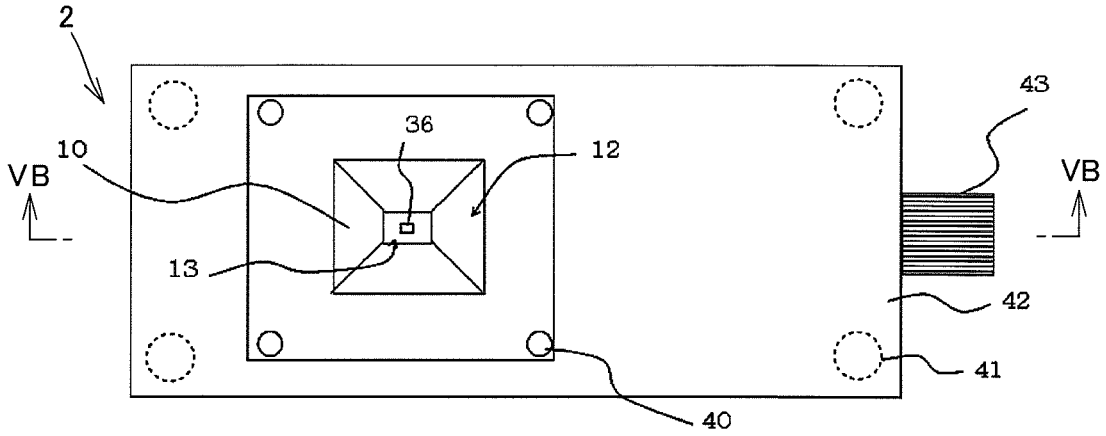
FIG. 5A is a plan view of a radio communication device 2 in accordance with a second embodiment as viewed from an opening 12 of a horn antenna 10.
Figure 5B:
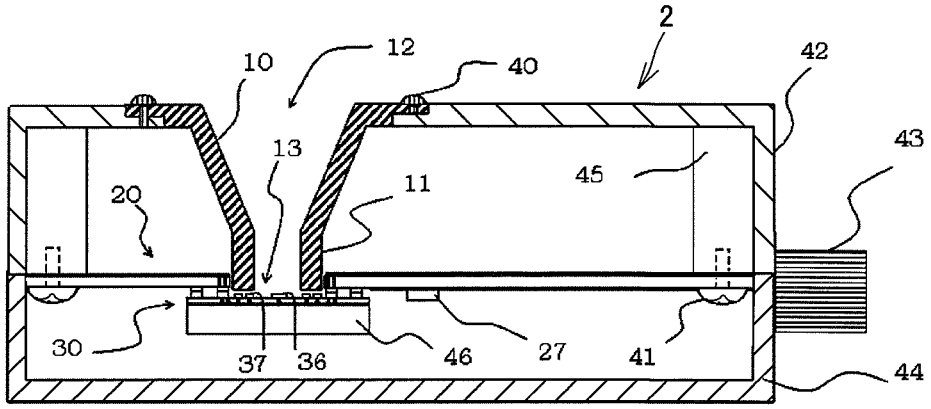
FIG. 5B is a cross sectional view taken along the line VB-VB in FIG. 5A.

A second embodiment of the present invention will now be described with reference to FIGS. 5A and 5B. Radio communication device 2 is obtained by incorporating antenna element-waveguide converter 1 described in the first embodiment into a housing formed by a chassis 42 and a frame 44, and attaching a signal terminal 43 for connection to an external apparatus (not shown). It should be noted that parts identical to those in the first embodiment are denoted by identical reference characters.

Chassis 42 and frame 44 are made of resin, and surface mounted component 27, such as a capacitor and a resistor, is mounted in advance on mounting board 20, in addition to antenna substrate 30. Mounting board 20 is attached to chassis 42 at corner portions 45 in the four corners with screws 41. Horn antenna 10 is attached to chassis 42 with screws 40. In more detail, horn antenna 10 and chassis 42 both have L-shaped ends, and are attached to each other with screws 40 after these L-shaped ends are combined together. Further, horn antenna 10 and chassis 42 are attached such that opening 13 of waveguide 11 coupled to horn antenna 10 and the surfaces of rectangular metal plates 37 arranged on antenna substrate 30 are located with a gap left therebetween in the direction perpendicular to the surface of antenna substrate 30. It should be noted that a shield cover 46 for electromagnetic shielding is attached to antenna substrate 30.

In accordance with the second embodiment, attaching the end of horn antenna 10 to the end of chassis 42 with screws 40 allows waveguide 11 coupled to horn antenna 10 to be fixed and positioned without being connected to either antenna substrate 30 or mounting board 20. Waveguide 11 and antenna substrate 30 are thereby arranged separately, so that a mechanical stress can be avoided. Moreover, although not shown, the waveguide can also be fixed and positioned with a supporting member interposed between horn antenna 10 or waveguide 11 and mounting board 20, instead of the above-described positioning of the waveguide by attaching horn antenna 10 to chassis 42.

In the second embodiment, since the surface wave propagating on the surface of antenna substrate 30 to the substrate edges is also reflected toward antenna element 36 by rectangular metal plates 37 as described in the first embodiment, a drop in antenna gain caused by arranging waveguide 11 and antenna substrate 30 with a gap left therebetween can be suppressed.

Third Embodiment

Figure 6A:
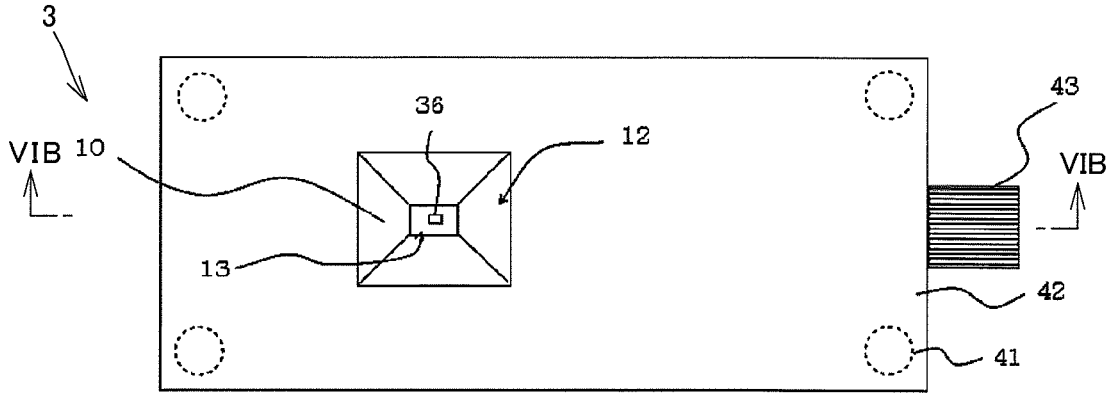
FIG. 6A is a plan view of a radio communication device 3 in accordance with a third embodiment as viewed from opening 12 of horn antenna 10.
Figure 6B:
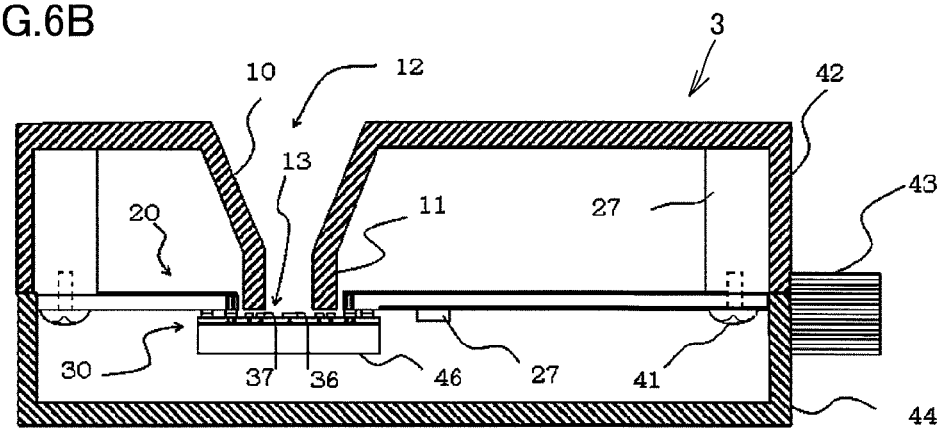
FIG. 6B is a cross sectional view taken along the line VIB-VIB in FIG. 6A.
Figure 7A:
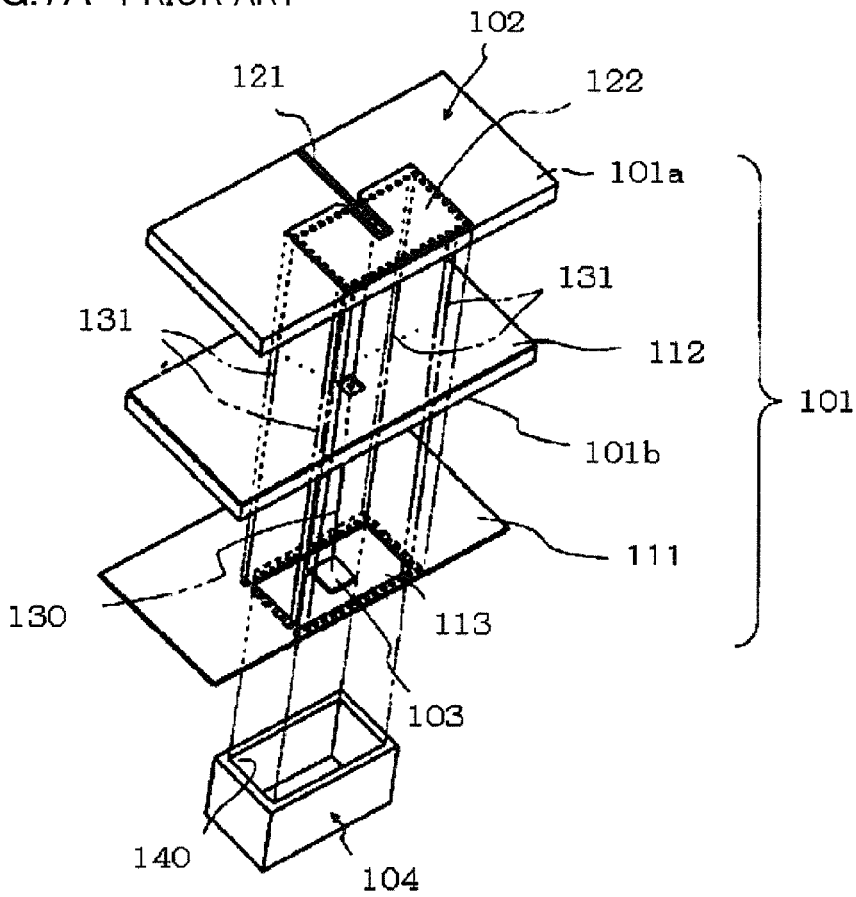
FIG.7A PRIOR ART
FIG. 7A is an exploded perspective view of the high frequency line-waveguide converter of the conventional radio communication device described in Japanese Patent Laying-Open No. 2008-131513.
Figure 7B:
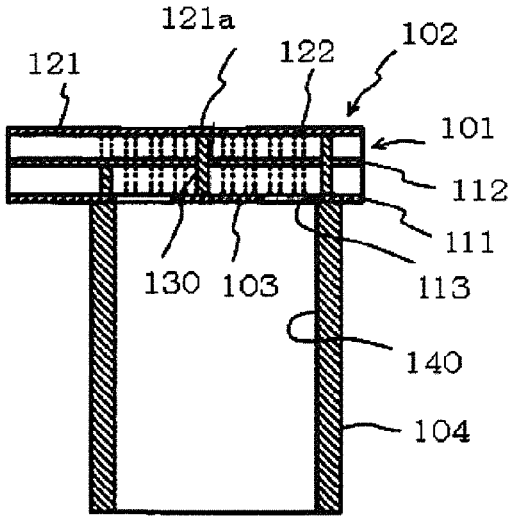
FIG.7B PRIOR ART
FIG. 7B is a central longitudinal sectional view of the high frequency line-waveguide converter of the radio communication device as assembled.

A third embodiment of the present invention will now be described with reference to FIGS. 6A and 6B. FIGS. 6A and 6B show an external appearance of a radio communication device 3. FIG. 6A is a plan view as viewed from horn antenna 10, and FIG. 6B is a cross sectional view taken along the line VIB-VIB in FIG. 6A. Radio communication device 3 is obtained by incorporating antenna element-waveguide converter 1 of the first embodiment shown in FIGS. 1A and 1B into an inner space enclosed by chassis 42 and frame 44, and attaching signal terminal 43 for connection to an external apparatus (not shown), to the outside of a connecting portion of chassis 42 and frame 44. It should be noted that elements in the third embodiment identical to those in the second embodiment are denoted by identical reference characters. The third embodiment differs from the second embodiment in that chassis 42, horn antenna 10, and waveguide 11 are integrally molded of metal, and in that frame 44 is also made of metal.

In the case of the third embodiment, since horn antenna 10 is integrated with chassis 42, which can reduce the number of components as compared to the second embodiment. Since chassis 42 and frame 44 are both made of metal, shield cover 46 for electromagnetic shielding of antenna substrate 30 can be eliminated depending on the requirements of shielding properties. Since horn antenna 10 and chassis 42 are made of the same material, the degree of thermal expansion of horn antenna 10 and chassis 42 is equal. Therefore, even if the ambient temperature varies, the gap between opening 13 of waveguide 11 coupled to horn antenna 10 and antenna substrate 30 is kept substantially constant. This in result can suppress fluctuations in antenna gain due to fluctuations in gap between opening 13 and antenna substrate 30 that would be caused by variations in ambient temperature.

The antenna element-waveguide converter of the present invention shown in each of the above-described embodiments is applicable to a microwave communication device and a milliwave radio communication device, each having an antenna function. It is also effective when embodying a compact and high-performance radio communication device, and can be applied to a radio transmission device of HDTV signals and so forth.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A radio communication device comprising:

a first substrate having, on one surface, an antenna element and a plurality of rectangular metal plates arranged around said antenna element;

a second substrate on which said first substrate is mounted;

a waveguide having, at one end, a first opening opposed to said one surface of said first substrate;

a horn antenna having a second opening coupled to said waveguide; and a housing accommodating said first substrate and said second substrate, surfaces of said plurality of rectangular metal plates and an end portion of a wall of the waveguide surrounding said first opening of said waveguide being arranged with a predetermined gap left therebetween in a direction perpendicular to said one surface of said first substrate, wherein said horn antenna is supported only by said housing.

2. A radio communication device comprising:

a first substrate having, on one surface, an antenna element and a plurality of rectangular metal plates arranged around said antenna element;

a second substrate on which said first substrate is mounted;

a waveguide having, at one end, a first opening opposed to said one surface of said first substrate;

a horn antenna having a second opening coupled to said waveguide; and a housing accommodating said first substrate and said second substrate, surfaces of said plurality of rectangular metal plates and an end portion of a wall of the waveguide surrounding said first opening of said waveguide being arranged with a predetermined gap left therebetween in a direction perpendicular to said one surface of said first substrate, wherein said horn antenna is integrally molded with said housing.

* * * * *